United States Patent [19]

Mulkins et al.

[11] 4,309,738

[45] Jan. 5, 1982

[54] IGNITER PLUG

[75] Inventors: George F. Mulkins, Bainbridge; Jerome P. Dombrowski; Gaston R. Isliker, both of Sidney, all of N.Y.

[73] Assignee: The Bendix Corporation, Southfield, Mich.

[21] Appl. No.: 144,491

[22] Filed: Apr. 28, 1980

[51] Int. Cl.[3] ..... F23Q 3/00

[52] U.S. Cl. ..... 361/253; 123/169 EL; 123/169 R; 361/261; 431/264

[58] Field of Search ..... 361/247, 253-263; 431/264, 265, 266; 219/383, 384; 123/143 A, 169 R, 169 CA, 169 CB, 169 EL, 169 E, 169 G, 169 P, 169 V, 169 MG; 60/39.67

[56] References Cited

U.S. PATENT DOCUMENTS

| | | | |
|---|---|---|---|
| 1,754,796 | 4/1930 | McElroy | 123/169 V |
| 2,336,569 | 12/1943 | Rabezzana | 123/169 EL |
| 2,701,324 | 2/1955 | Peroutky et al. | 123/169 R X |
| 2,733,385 | 1/1956 | Bychinsky | 361/253 |
| 3,207,953 | 9/1965 | Smith et al. | 361/253 |
| 3,292,606 | 12/1966 | Ervin | 123/169 EL |
| 3,988,646 | 10/1976 | Atkins | 361/263 |
| 4,186,712 | 2/1980 | Fitzner et al. | 123/169 EL |

*Primary Examiner*—Volodymyr Y. Mayewsky
*Attorney, Agent, or Firm*—Raymond J. Eifler

[57] ABSTRACT

An igniter plug that includes a metal sleeve 10 to retain a central electrode 30 within a ceramic insulator 40 to prevent vibration of the electrode tip 35 during operation.

4 Claims, 4 Drawing Figures

IGNITER PLUG

TECHNICAL FIELD

This invention relates to an igniter for igniting combustible materials and more particularly to an improved igniter plug for igniting fuel in a turbine or jet engine.

BACKGROUND OF THE INVENTION

FIG. 1 illustrates a prior art igniter which generally comprises a metal shell or body 20 that has a flange or mounting means (not shown) for mounting the igniter to an engine. The shell 20 constitutes one electrode of the igniter plug. A central electrode 30 passes through the shell and is supported by an insulator 40 which surrounds the central electrode 30. The forward end 35 of electrode 30 is isolated from the forward end 24 of the metal shell 20 by an electrically insulating ceramic sleeve 80. The insulator 80 is captivated within the shell 20 by a ring 23 and the forward end of the shell 20. In operation an arc is formed between the forward surface 24*a* of the forward end 24 of the outer electrode 20 and the forward end 35 of the electrode 30. This subjects the insulator 80 to intense heat and it expands. Some igniters also have a semiconductive coating across the front surface 84 of the insulator 80 to facilitate arcing during starting. Often, on and off operation of the igniter causes the forward end 35 of the electrode 30 to expand and contract at different thermal coefficients of expansion and contraction than the ceramic material 80. In many igniters this causes the ceramic insulatiing material 80 to crack. In some igniters this cracking was prevented by allowing space between the electrode tip 35 and the ceramic 80. However, in others, erosion created a space between the ceramic 80 and the electrode tip 35 causing the front end 35 of the electrode to vibrate in operation. Vibration is undesirable because: (1) stresses are applied to the electrode tip 35 that could cause the tip 35 to break away from the electrode 30; and wear between the vibrating surfaces 35 and 80 widen the gap between them requiring a higher starting voltage.

DISCLOSURE OF THE INVENTION

This invention provides an igniter having a central electrode that is resistant to vibration during operation.

The invention is characterized by a metal sleeve 10 which retains a central electrode 30 within a ceramic insulator 40 to prevent vibration of the electrode tip 35 during operation.

Accordingly, one advantage of the invention is to provide an igniter whose electrode tip is relatively free from vibration during operation.

Another advantage is that cracking of the forward insulator during operation is eliminated.

DETAILED DESCRIPTION OF THE INVENTION

Figures 1, 2, 3, 4:
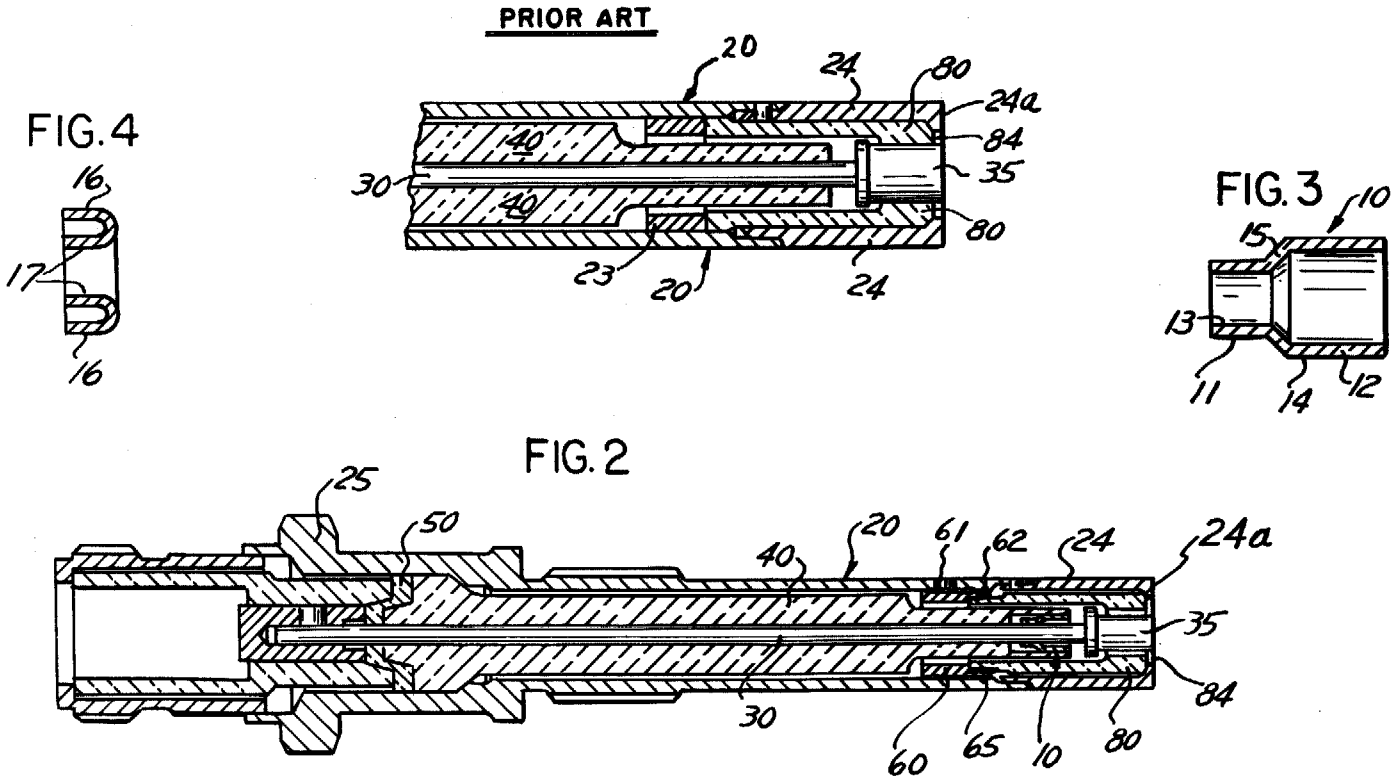
FIG. 1 PRIOR ART
FIG. 1 illustrates a portion of a prior art igniter.
FIG. 2 illustrates an igniter incorporating the principals of this invention.
FIG. 3 illustrates a retaining sleeve for the central electrode.
FIG. 4 is an alternate embodiment of the sleeve shown in FIG. 3.

FIG. 2 illustrates an igniter which comprises: an outer metal shell 20 which is one of the electrodes of the igniter; a first tubular insulator 40; a central electrode 30; a second tubular (forward) insulator 80 which insulates the forward tip 35 of the electrode 30 from the forward portion 24 of the shell 20; a glass seal 50 for hermetically sealing the internal portions of the shell 20; and a metal sleeve 10. The second and forward insulator 80 may include a semi conductor material on at least the forward surface 84 to facilitate arcing (starting) between the electrode tip 35 and forward surface 24*a* of the outer shell 20. Also shown is a mounting flange 25 on the rear portion of the outer electrode 20.

In this embodiment of the invention the forward tip 35 of the electrode 30 is spaced from the electrical insulator 80, which electically isolates the inner electrode 30 from the outer electrode 20. To prevent vibration of the electrode tip 35 during operation, a metal sleeve 10 is mounted within the insulator 40 and around a portion of the electrode 30.

A metal ring 60 having a forward portion 65 connects the insulator 80 to the outer shell 20. This is accomplished by welding at 61 the metal ring 60 to the outer shell 20 after brazing at 62 the insulator 80 to the ring 60. The brazing between the metal sleeve and ceramic insulator 80 is accomplished by using a Titanium hydride powder and a Silver-Copper Eutectic brazing alloy; and is best accomplished in a vacuum furnace at $1\times10^{-4}$ Torr at a temperature of about 1760° F.

FIG. 3 illustrates the details of a one piece metal sleeve 10 which includes an enlarged diameter portion 12 having an outer surface 14 which is adapted to contact the inner surface of the forward insulator 40; and a smaller diameter portion 11 having an inside surface 13 which is adapted to contact the outer surface of the electrode 30. The smaller diameter portion 11 is connected to the larger diameter portion 12 by a tapered portion 15.

FIG. 4 illustrates a cutaway view of an alternate embodiment of the sleeve 10 shown in FIG. 3. In this embodiment a "U" shaped ring or partial ring includes an outside surface 16 for contacting the inner surface of the forward insulator 40 and an inside surface 17 for contacting the outer surface of the electrode 30.

While a preferred embodiment of the invention has been disclosed, it may be apparent to others skilled in the art that changes may be made to the invention as set forth in the appended claims, and in some instances, certain features of the invention may be used to advantage without corresponding use of other features. For example, the metal sleeve 10 may be any shape that provides a bias between the central electrode 30 and insulator 40. Accordingly, it is intended that the illustrative and descriptive materials herein be used to illustrate the principals of the invention and not to limit the scope thereof.

Having described the invention, what is claimed is:

1. In combination with an igniter plug of the type having an inner elongated electrode having a front portion and a rear portion; an elongated insulator disposed around at least a portion of the electrode, said insulator having a front portion, a rear portion, and an axial passage extending through said insulator and having a portion of the inner electrode mounted therein; an outer elongated electrode comprising a metal shell mounted on the intermediate elongated insulator and disposed around the electrode and electrically isolated therefrom by the insulator, said metal shell having a rear portion and a front end portion which is arranged to provide a spark gap with the end of the front portion of said electrode; means for mounting the elongated insulator within said metal shell; means for providing a pressure-tight seal between said inner electrode, said elongated insulator and said metal shell; a forward insulator electrically isolating said forward portion of said outer shell from the forward portion of said inner electrode and being separated by an air space from said inner electrode; and means for mounting the forward portion of said inner electrode to the forward portion of said elongated insulator, the improvement wherein said last means comprises:

a metal sleeve telescopically mounted to said inner electrode in the front portion of said insulator passage, said metal sleeve comprising a single piece of metal having a central passage that includes a first passage portion having a large cross sectional area and a second passage portion having a small cross sectional area connected together by a third passage portion, the inside surface of said second passage portion in contact with said electrode extending therethrough and the outside surface of said first passage portion in contact with said insulator passage.

2. The igniter plug recited by claim 1 wherein the wall of said metal sleeve is substantially uniform in thickness.

3. In combination with an igniter plug of the type having an inner elongated electrode having a front portion and a rear portion; an elongated insulator disposed around at least a portion of the electrode, said insulator having a front portion, a rear portion, and an axial passage extending through said insulator and having a portion of the inner electrode mounted therein, an outer elongated electrode comprising a metal shell mounted on the intermediate elongated insulator and disposed around the electrode and electrically isolated therefrom by the insulator, said metal shell having a rear portion and a front end portion which is arranged to provide a spark gap with the end of the front portion of said electrode; means for mounting the elongated insulator within said metal shell; means for providing a pressure-tight seal between said inner electrode, said elongated insulator and said metal shell; a forward insulator electrically isolating said forward portion of said outer shell from the forward portion of said inner electrode and being separate by an air space from said inner electrode; and means for mounting the forward portion of said inner electrode to the forward portion of said elongated insulator, the improvement wherein said last means comprises:

a U shaped annular member telescopically mounted to said inner electrode in the front portion of said insulator passage, said member comprised of a single piece of metal having an inside surface in contact with said electrode and an outside surface in contact with said insulator passage.

4. The igniter plug recited by claim 3 wherein the wall of said U shaped annular member is substantially uniform in thickness.

* * * * *